United States Patent [19]

Diard et al.

[11] Patent Number: 4,971,349

[45] **Date of Patent: * Nov. 20, 1990**

[54] SKI HAVING UPPER AND LOWER SURFACES OF DIFFERING WIDTH

[75] Inventors: Jean-Luc Diard, Annecy; Roger Pascal, Annecy Le Vieux, both of France

[73] Assignee: Salomon S.A., Annecy Cedex, France

[ * ] Notice: The portion of the term of this patent subsequent to Jan. 3, 2006 has been disclaimed.

[21] Appl. No.: 49,929

[22] Filed: May 15, 1987

[30] Foreign Application Priority Data

May 23, 1986 [FR] France ..... 86 07850

[51] Int. Cl.[5] ..... A63C 5/04

[52] U.S. Cl. ..... 280/609

[58] Field of Search ..... 280/601, 608, 609, 600, 280/28; 441/65, 68, 79; 114/274, 283, 288

[56] References Cited

U.S. PATENT DOCUMENTS

| | | | |
|---|---|---|---|
| Re. 29,659 | 6/1978 | Bildner | 280/608 |
| 4,433,855 | 2/1984 | Wyke | 280/609 |
| 4,533,150 | 8/1985 | Hardy | 280/609 |

FOREIGN PATENT DOCUMENTS

| | | | |
|---|---|---|---|
| 166717 | 1/1986 | European Pat. Off. | 280/609 |
| 1958349 | 5/1971 | Fed. Rep. of Germany . | |
| 2461890 | 10/1976 | Fed. Rep. of Germany . | |
| 3012307 | 10/1980 | Fed. Rep. of Germany . | |
| 3308599 | 9/1983 | Fed. Rep. of Germany . | |
| 3441058 | 5/1986 | Fed. Rep. of Germany . | |
| 1343014 | 10/1963 | France . | |
| 2509185 | 1/1983 | France . | |
| 2517548 | 2/1985 | France . | |
| 2559673 | 8/1985 | France . | |
| 43-24330 | 10/1968 | Japan . | |

*Primary Examiner*—Charles A. Marmor
*Assistant Examiner*—Tamara L. Finlay
*Attorney, Agent, or Firm*—Sandler, Greenblum & Bernstein

[57] ABSTRACT

A ski provided with an upper surface, a lower surface, and two lateral surfaces connecting the upper and lower surfaces. At least a portion of each lateral surface is inclined with respect to the lower surface, and the width of the lower surface, at each point along the length of the ski, is greater than the width of the upper surface at each point along the length of the ski.

40 Claims, 4 Drawing Sheets

SKI HAVING UPPER AND LOWER SURFACES OF DIFFERING WIDTH

FIELD OF THE INVENTION

The present invention generally relates to skis for use in connection with winter sports, and more particularly, for use on winter surfaces, including snow and ice.

DESCRIPTION OF BACKGROUND AND RELEVANT INFORMATION

Skis normally used on snow or ice comprise a lower surface, for sliding on the snow or ice, and an upper surface. These upper and lower surfaces are connected by two lateral surfaces. Generally, the lower portions of these lateral surfaces are provided with metallic edges. For skis known in the art, the lateral surfaces generally are substantially perpendicular to the lower and upper surfaces.

To provide stability and ease in starting a turn, the central portion of the lower surface of skis known in the art is narrower than the front and rear portions, and the lateral surfaces have a concave longitudinal profile. As a result, the upper surface of such skis is likewise of variable width, such width being less in the central portion, and greater at the ends. Accordingly, the two edges forming the border of the upper surface along its length are curvilinear.

The variable width structure of such skis tends to complicate their manufacture, and is an impediment to mass production. Such structure likewise increases the difficulty of forming upper edges for the skis having sufficient mechanical resistance. Further, to enable the addition of decoration to the upper surface of the ski, relatively complex reference and centering means are required.

The present invention is a ski having a novel shape which overcomes the indicated disadvantages of conventional structures.

In a preferred embodiment, the upper surface of the ski of the invention has a constant, not differing width or substantially constant, width over the entire length of the body of the ski. Thus, the upper edges of the ski are parallel and rectilinear, or substantially so. Where this structure of the ski is formed by pre-impregnation of fibrous materials, the formation of the fold at the level of the upper edges is facilitated, and, thereby, the fibers are positioned in a more regular fashion. As a result, the upper edges of the ski have greater mechanical resistance.

Furthermore, because the upper edges are rectilinear and parallel, simpler apparatus can be used to manufacture the ski. In effect, it is simpler and less expensive to provide the various required apparatus, such as molds, for shapes which are primarily rectilinear.

The rectilinear and parallel edges of the upper surface serve as simple and useful references for applying decoration to the upper surface of the ski.

Constant width of the upper surface permits increased standardization of the materials-used in constructing the ski. In effect, the width of the upper surface can be determined independently of the length of the skis to be formed, over at least a certain range of variation. Moreover, the necessity of preparing lateral cutouts of variable shape can be avoided. Yet further, the upper surface of the ski can be formed from bands of constant width, independently of the length of the ski to be constructed.

To achieve these and other objectives, the upper surface of a preferred embodiment of the ski of the invention has a substantially constant width over its entire length, and is connected to the lower surface by lateral surfaces which are inclined, i.e., bevelled. The angle of inclination of these lateral, i.e., side surfaces varies along the length of the ski as a function of the thickness of the ski, and as a function of the width of its lower surface.

In a particularly preferred embodiment, the upper surface of the ski is narrower than the narrowest portion of the lower surface. Thus, in this embodiment, the lateral surfaces converge upwardly, and thereby are capable of carrying inscriptions which are visible both from the side and from the top of the ski.

The constant width of the upper surface of the preferred embodiment of the ski of the invention allows for a further particularly preferred embodiment of the ski, characterized by symmetry along a vertical median longitudinal plane. The constant width of the upper surface is also compatible with dissymmetrical embodiments.

SUMMARY OF THE INVENTION

The ski of the invention is provided with an upper surface, a lower surface, and two lateral surfaces which connect these upper and lower surfaces. At least a portion of each lateral surface is inclined with respect to the lower surface, and the width of the lower surface, at each point along the length of the ski,-is greater than the width of the upper surface at each said point along the length of the ski.

In a preferred embodiment, the distance separating these upper and lower surfaces varies along the length of the ski. More preferably, this distance decreases from a point located between the ends of the ski towards at least one end of the ski.

This point may be located substantially at the center of the ski along its length. Preferably, the distance decreases from this point towards both ends of the ski.

The width of at least one of the upper and lower surfaces of the ski may vary along the length of the ski. Preferably, the width of only one of these upper and lower surfaces so varies; most preferably, it is the width of the lower surface which varies along the length of the ski.

In a preferred embodiment, the width of the upper surface is substantially constant. More preferably, the width of the lower surface, at the narrowest point along the length of the lower surface, is greater than the width of the upper surface at any point along the length of the upper surface.

In a particularly preferred embodiment, the width of the lower surface increases, from a point located between the ends of the ski along the length of the ski, towards at least one end of the ski. The width of the lower surface may increase from this point towards both ends of the ski. Preferably, this point is located substantially at the center of the ski along its length.

Referring to the distance separating the upper and lower surfaces of the ski of the invention, as well as to the width of at least one of these upper and lower surfaces, at least one of these parameters may vary along the length of the ski. Particularly as to the second of these parameters, it is preferably the width of the lower surface which varies along the length of the ski.

Within the scope of the invention, both the distance separating the upper and lower surfaces of the ski, and the width of the lower surface, may vary along the length of the ski. Preferably, in this embodiment, the distance separating the upper and lower surfaces of the ski decreases, from a point located substantially at the center of the ski along its length, towards both ends of the ski; the width of the lower surface increases, from a point located substantially at the center of the ski along its length, towards both ends of the ski. Most preferably, the width of the upper surface is substantially constant.

In another embodiment, the invention is directed to a ski comprising an upper surface, a lower surface, and two lateral surfaces each connecting these upper and lower surfaces, wherein the width of the upper surface, along at least one point of the length of the upper surface, is different from the width of the lower surface along at least one point of the length of the lower surface.

Yet another embodiment of the ski according to the invention is provided with an upper surface, a lower surface, and two lateral surfaces connecting the upper and lower surfaces, wherein the widths of the upper and lower surfaces differ at each point along the length of the ski intersected by both the upper surface and the lower surface.

In any of the foregoing embodiments, at least one of the upper and lower surfaces of the ski of the invention may be provided with a vertical plane of symmetry.

Preferably, each of such surfaces is provided with a vertical plane of symmetry. These planes of symmetry may be coincident. Alternatively, they may be separated by a constant distance over the length of the ski. Yet further, they may be separated by a distance which varies over the length of the ski.

Where the distance separating the planes of symmetry varies along the length of the ski, these planes may intersect at a point along the length of the ski. Preferably, this point is located substantially at the center of the ski along its length.

The ski according to the invention may be provided with an upper surface having a substantially constant width over the length of the ski, a lower surface, and two lateral surfaces each connecting these upper and lower surfaces; at least a portion of each such lateral surface is inclined, each lateral surface thereby forming at least one angle of inclination between the lower surface and the inclined portion of the lateral surface, with the degree of inclination of this angle varying along the length of the ski. Preferably, this degree of inclination varies as a function either of the width of the lower surface, or of the distance separating the upper and lower surfaces.

The upper surface of the ski of the invention may be provided with a vertical plane of symmetry. In one preferred embodiment, the inclined lateral surfaces are symmetrical on either side of this plane; in another preferred embodiment, the inclined lateral surfaces are dissymmetrical on either side of this plane.

Regarding the previously discussed angle of inclination, at a point located substantially in the center of the ski along its length, the degree of inclination of this angle may be between approximately 70°-90°; at the ends of the ski, the degree of inclination of the angle may be between approximately 10°-30°.

In a preferred embodiment of the ski according to the invention, the width of the lower surface is greater, at the narrowest point along the length of the lower surface, than the width of the upper surface at any point along the length of the upper surface.

The invention will now be described with reference to the following drawings, which are provided by way of example, not limitation.

DESCRIPTION OF PREFERRED EMBODIMENTS

Figure 5:
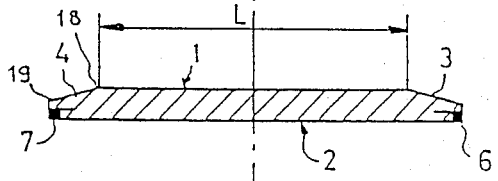
Figure 6:
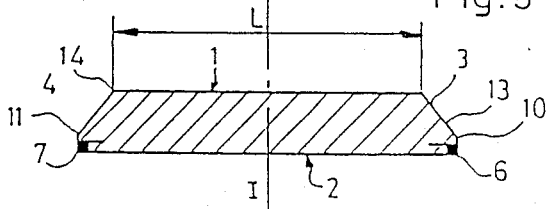
Figure 7:
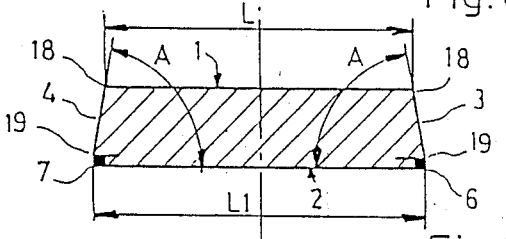
Figure 8:
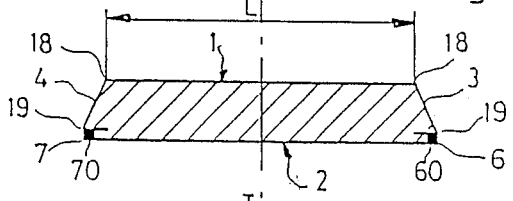
Figure 9:
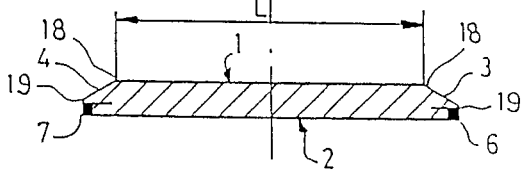

As shown in the Figures, the ski according to the present invention comprises upper surface 1, lower sliding surface 2, and two lateral, i.e., side surfaces 3 and 4. The front portion of the ski is curved upwardly to form spatula 5. Two lower edges 6 and 7 of lower surface 2 are preferably provided with metallic rims 60 and 70, respectively. At the cross-section taken along plane D—D, as shown in FIG. 7, lower surface 2 has a relatively reduced width, which progressively increases toward the two ends of the ski. Thus, the width of lower surface 2 is greater at the cross-section taken along plane F—F, as shown in FIG. 9, and at the cross-section taken along plane B—B, as shown in FIG. 5.

On the other hand, upper surface 1 has a constant, or substantially constant, width L over the entire length of the body of the ski.

The thickness of the ski, or, in other words, the distance separating lower surface 2 and upper surface 1, varies along the length of the ski. Preferably, this thickness is greater at or near the middle of the ski, and tapers toward either or both ends. Thus, as shown in FIGS. 5–9, the thickness of the ski is greater at the cross-section taken along plane D—D, as shown in FIG. 7, and more reduced at the cross-sections,, taken along planes B—B and F—F, as shown in FIGS. 5 and 9, respectively.

The degree of inclination of lateral surfaces 3 and 4 varies to allow for the connection between upper surface 1, having constant width, and lower surface 2, having variable width, as well as to accommodate the variations in the thickness of the ski along its length. Each of surfaces 3 and 4 intersects with lower surface 2 to form an interior angle of inclination A, as shown in FIG. 7.

The degree of inclination of angle A varies as a function of the position, along the length of the ski, of the cross-section at which the angle is measured. At the cross-section taken along plane D—D, angle A is preferably greater than at cross-sections taken in portions adjacent to the ends of the ski.

Preferably, width L of upper surface 1 is less than minimum width L1 of lower surface 2. Minimum width L1 is shown in FIG. 7 in the central zone of the ski at the cross-section taken along plane D—D. Accordingly, angle A remains less than 90° along the length of the ski; therefore, upper edges 18 of the ski exhibit greater mechanical resistance, and are also less sharp, as well as less subject to abrasion.

In the embodiment shown in FIGS. 3–9, the lateral surfaces are symmetrical with respect to longitudinal vertical median plane I—I of the ski.

At the cross-section taken along plane D—D, angle A preferably measures between 70° and 90°. In the end portions of the ski, at cross-sections taken along planes F—F or B—B, angle A is preferably between 10° and 30°.

At least a portion of lateral surfaces 3 and 4, taken in cross-section, can be rectilinear, or substantially rectilinear, as shown in the Figures. Further, nonrectilinear, or uneven surfaces, may also be employed. More particularly, such uneven lateral surfaces can be of any suitable curvilinear shape. As specific examples, the lateral surfaces can be concave or convex. Accordingly, regardless of the shape of the lateral surfaces, their degree of inclination is defined by a straight line connecting lower edge 19 and upper edge 18 of the ski.

In the embodiment of FIGS. 3–9, the ski is symmetrical; more specifically, the planes of symmetry of each of upper surface 1 and lower surface 2 are coincident, or substantially coincident. In this embodiment, the ski is provided with a single vertical plane of symmetry I—I.

Figure 1:
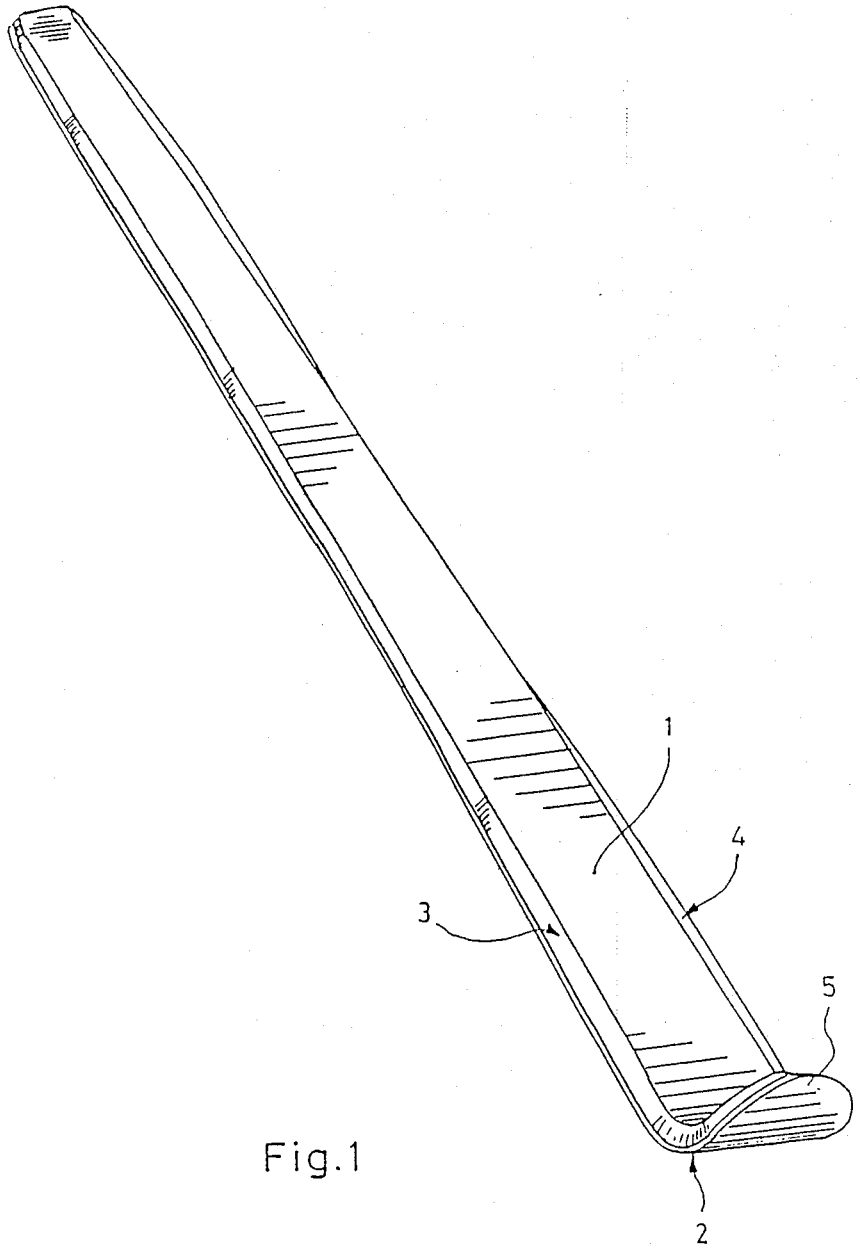
FIG. 1 is a perspective view of the ski according to the present invention.
Figure 2:
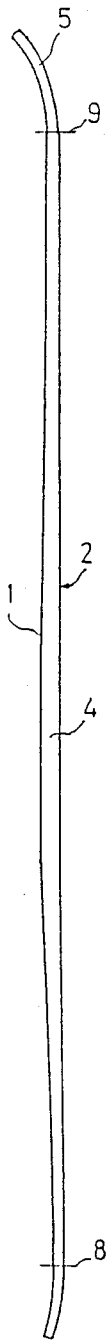
FIG. 2 is a side view of the ski.
Figure 10:
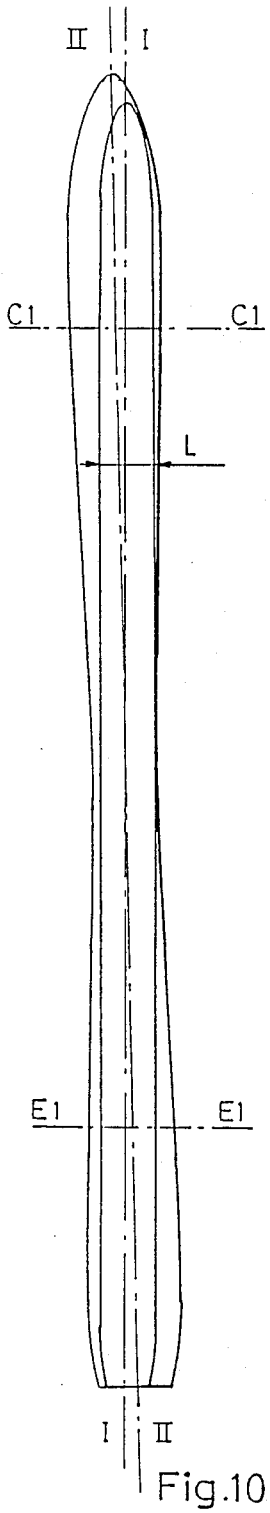
FIG. 10 is a top view of a first dissymetrical embodiment of the ski of the invention.
Figure 11:
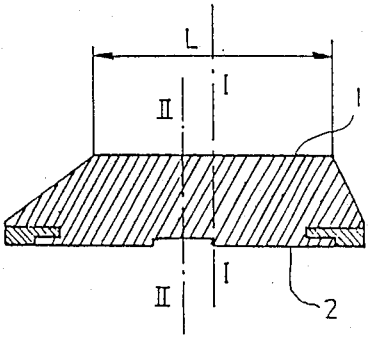
FIGS. 11–12 are cross-sectional views of the ski of FIG. 10 along planes C1 and E1, respectively.
Figure 12:
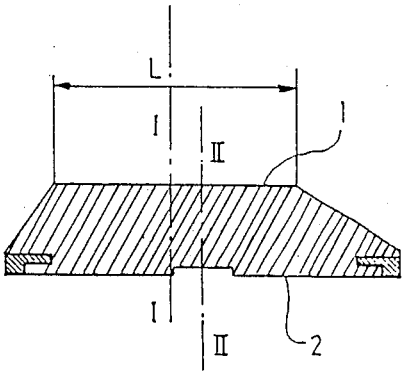
Figure 3:
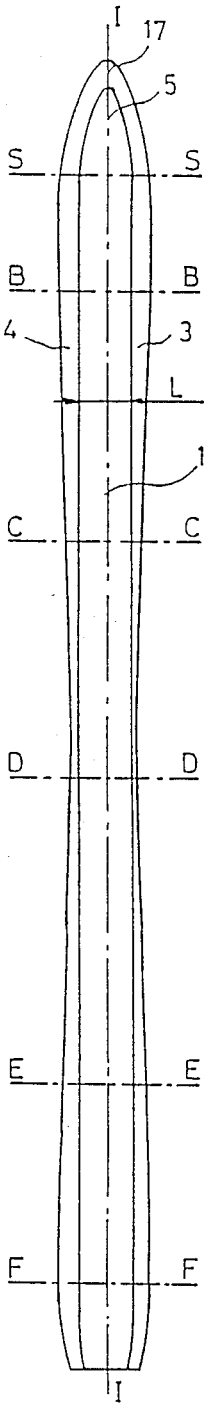
FIG. 3 is a top view of a first dissymmetrical embodiment of the ski.
Figure 4:
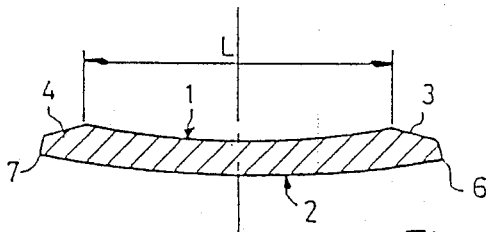
FIGS. 4–9 are cross-sectional views over the length of the ski shown in FIG. 3, taken along planes S, B, C, D, E, and F, respectively.

In the embodiment of FIGS. 10–12, the ski is dissymmetrical. Upper surface 1 and lower surface 2 have planes of symmetry I—I and II—II, respectively, which are angularly offset; in other words, the distance separating planes I—I and II—II varies along the length of the ski. Preferably, as specifically shown in FIGS. 10–12, these planes converge at a point along the interior of the length of the ski; on either side of this point of convergence, these planes diverge, and the distance between them increases towards the ends of the ski.

Figure 13:
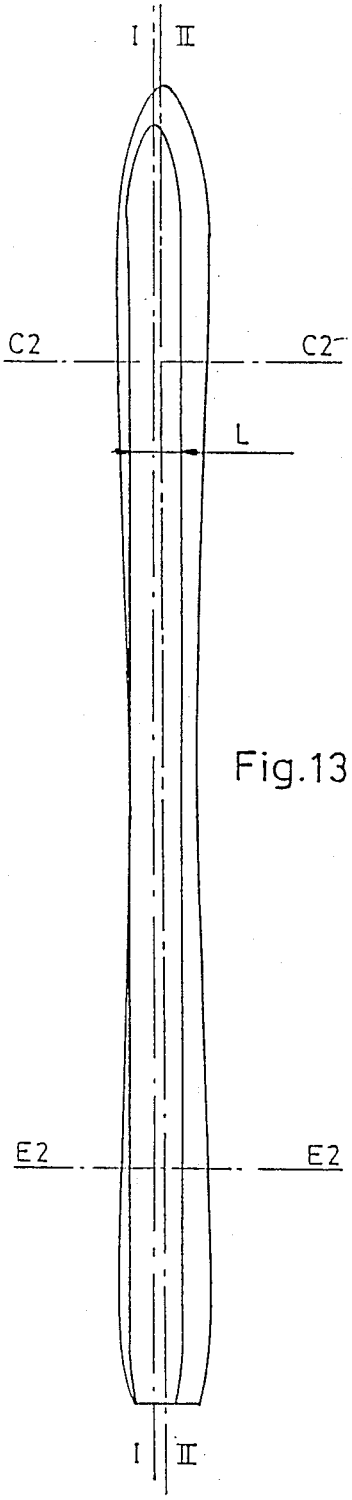
FIG. 13 is a top view of a second dissymmetrical embodiment of the ski of the invention.
Figure 14:
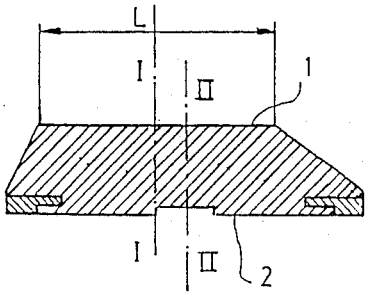
FIGS. 14–15 are cross-sectional views of the ski shown in FIG. 13 taken along planes C2 and E2, respectively.
Figure 15:
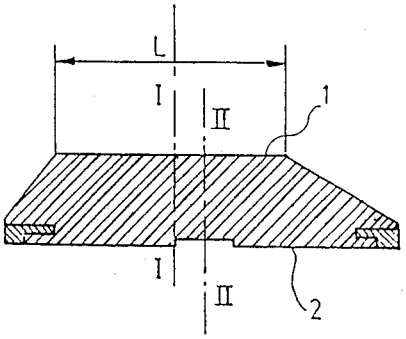

The embodiments of FIGS. 13–15 is likewise dissymmetrical. However, in this embodiment, upper surface 1 and lower surface 2 are provided with planes of symmetry I—I and II—II, respectively, which are parallel, and laterally offset with respect to one another; in other words, the distance separating planes I—I and II—II stays constant, or substantially constant, along the length of the ski.

It is further understood that although the invention has been specifically described with reference to particular means and embodiments, the foregoing description is that of preferred embodiments of the invention. The invention is not limited to the particulars disclosed, but extends to all equivalents, and various changes and modifications may be made in the invention without departing from the spirit and scope thereof.

We claim:

1. A ski comprising an upper surface, a lower surface, and two lateral surfaces extending between said upper and lower surfaces, wherein along a substantial length of said ski at least a portion of each of said lateral surfaces is inclined with respect to said lower surface, wherein the width of said lower surface, along a substantial length of said ski, being greater than the width of said upper surface along said substantial length of said ski, wherein said width of said lower surface varies along said substantial length of said ski, and wherein said width of said upper surface is substantially constant along said substantial length of said ski.

2. The ski as defined in claim 1 wherein the width of said lower surface, at the narrowest point along the length of said lower surface, is greater than the width of said upper surface at any point along the length of said upper surface.

3. The ski as defined by claim 1 wherein the width of said lower surface increases, from a point located between the ends of the ski along the length of the ski, towards at least one end of the ski.

4. The ski as defined by claim 3 wherein said point is located substantially at the center of the ski along its length.

5. The ski as defined by claim 4 wherein said width increases from said point towards both ends of the ski.

6. The ski as defined by claim 1 wherein at least a substantial portion of each of said lateral surfaces, taken in cross-section, are substantially rectilinear.

7. The ski as defined by claim 1 wherein at least one of the distance separating said upper and lower surfaces, and the width of said lower surface, varies along said substantial length of said ski.

8. The ski as defined by claim 1 wherein at least one of the distance separating said upper and lower surfaces, and the width of said lower surface, varies along said substantial length of said ski.

9. The ski as defined by claim 8 wherein both said distance separating said upper and lower surfaces and said width of said lower surface vary along the length of the ski.

10. The ski as defined by claim 9 wherein the distance separating said upper and lower surfaces decreases, from a point located substantially at the center of the ski along its length, toward both ends of the ski, and wherein the width of said lower surface increases from a point located substantially at the center of the ski along its length towards both ends of the ski.

11. The ski as defined by claim 1 wherein each of said portions of each of said two lateral surfaces form at least one angle of inclination with said lower surface, the degree of inclination of said angle varying along said substantial length of said ski.

12. The ski as defined in claim 11 wherein said degree of inclination varies as a function of the width of said lower surface.

13. The ski as defined by claim 11 wherein said degree of inclination varies as a function of the distance separating said upper and lower surfaces.

14. The ski as defined by claim 11 wherein said upper surface has a vertical plane of symmetry.

15. The ski as defined by claim 14 wherein said inclined lateral surfaces are symmetrical on either side of said vertical plane of symmetry.

16. The ski as defined by claim 14 wherein said inclined lateral surfaces are dissymmetrical on either side of said vertical plane of symmetry.

17. The ski as defined by claim 14 wherein, at a point located substantially in the center of the ski along its length, the degree of inclination of said angles is between approximately 70°–90°.

18. The ski as defined by claim 14 wherein, at the ends of the ski, the degree of inclination of said angles is between approximately 10°–30°.

19. The ski as defined by claim 14 wherein the width of said lower surface is greater, at the narrowest point along the length of said lower surface, than the width of said upper surface at any point along the length of said upper surface.

20. A ski comprising an upper surface, a lower surface, and two lateral surfaces extending between said upper surface and said lower surface, wherein for any transverse cross-section along a substantial length of said ski, the widths of said upper and lower surfaces differ, wherein both of said upper and lower surfaces have vertical planes of symmetry, wherein said two lateral surfaces are inclined with respect to said lower surface, and wherein the width of said upper surface is constant.

21. The ski as defined by claim 20 wherein the width of said lower surface, at the narrowest point along the length of said lower surface, is greater than the width of said upper surface at any point along the length of said upper surface.

22. The ski as defined by claim 20 wherein said planes of symmetry are separated by a constant distance over the length of the ski.

23. The ski as defined by claim 22 wherein the width of said lower surface, at the narrowest point along the length of said lower surface, is greater than the width of said upper surface at any point along the length of said upper surface.

24. The ski as defined by claim 23 wherein the width of said lower surface increases from a point, located substantially at the center of the ski along its length, toward at least one end of the ski.

25. The ski as defined by claim 24 wherein said width of said lower surfaces increases from said point toward both ends of the ski.

26. The ski as defined by claim 20 wherein said planes of symmetry are substantially coincident.

27. The ski as defined by claim 26 wherein the width of said lower surface, at the narrowest point along the length of said lower surface, is greater than the width of said upper surface at any point along the length of said upper surface.

28. The ski as defined by claim 27 wherein the width of said lower surface increases from a point, located substantially at the center of the ski along its length, toward at least one end of the ski.

29. The ski as defined by claim 28 wherein said width of said lower surface increases from said point toward both ends of the ski.

30. The ski as defined by claim 20 wherein said planes of symmetry are separated by a distance which varies along the length of the ski.

31. The ski as defined by claim 30 wherein said planes of symmetry intersect at a point along the length of the ski.

32. The ski as defined by claim 31 wherein the point of intersection is substantially in the center of the ski along its length.

33. The ski as defined by claim 31 wherein the width of said lower surface is greater, at the narrowest point along the length of said lower surface, than the width of said upper surface at any point along the length of said upper surface.

34. The ski as defined by claim 33 wherein the width of said lower surface increases from a point located substantially at the center of the ski along its length toward at least one end of the ski.

35. The ski as defined by claim 34 wherein said width increases from said point toward both ends of the ski.

36. A ski comprising:

(a) an upper surface having a substantially constant width over a substantial length of the ski and having a vertical plane of symmetry;

(b) a lower surface;

(c) a pair of lateral side surfaces defining at least a portion of each lateral side of said ski and extending between said upper surface and said lower surface, each of said lateral side surfaces being non-parallel with said vertical plane of symmetry of said upper surface of said ski along a substantial length of said ski.

37. The ski of claim 36 wherein each of said lateral side surfaces are oriented relative to said vertical plane of symmetry of said lower surface of said ski to define an angle of inclination which varies along at least a portion of the length of said ski.

38. The ski of claim 37 wherein said angle of inclination varies along said ski as a function of the width of said lower surface.

39. The ski of claim 37 wherein said angle of inclination varies along said ski as a function of the distance separating said upper and lower surfaces.

40. The ski of claim 36 wherein the lower surface of said ski has a width which is greater than said constant width of said upper surface over a substantial length of said ski.

* * * * *